US007108614B2

(12) United States Patent
Lo

(10) Patent No.: US 7,108,614 B2
(45) Date of Patent: Sep. 19, 2006

(54) GOLF CLUB HEAD WITH IMPROVED STRIKING EFFECT

(75) Inventor: Lai-Fa Lo, Taoyuan Hsien (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 0 days.

(21) Appl. No.: 10/894,065

(22) Filed: Jul. 20, 2004

(65) Prior Publication Data

US 2006/0019769 A1 Jan. 26, 2006

(51) Int. Cl.
*A63B 53/04* (2006.01)

(52) U.S. Cl. ..... 473/345; 473/349; 473/346

(58) Field of Classification Search ..... 473/349, 473/345–346

See application file for complete search history.

(56) References Cited

U.S. PATENT DOCUMENTS 3,695,618 A * 10/1972 Woolley et al. ..... 473/342
5,997,415 A * 12/1999 Wood ..... 473/346
6,623,378 B1 9/2003 Beach et al.
6,792,972 B1 * 9/2004 Poulsen ..... 137/484.4
2002/0019265 A1 * 2/2002 Allen ..... 473/329
2003/0228932 A1 * 12/2003 Ehlers et al. ..... 473/342
2004/0192468 A1 * 9/2004 Onoda et al. ..... 473/345
2005/0037861 A1 * 2/2005 Kobayashi ..... 473/345
2005/0096154 A1 * 5/2005 Chen ..... 473/345
2005/0143189 A1 * 6/2005 Lai et al. ..... 473/335

FOREIGN PATENT DOCUMENTS

JP 2003-111874 A 4/2003

* cited by examiner

*Primary Examiner*—Sebastiano Passaniti
(74) *Attorney, Agent, or Firm*—Birch, Stewart, Kolasch & Birch, LLP

(57) ABSTRACT

A golf club head includes a body and at least one light cover. The body includes a striking face for striking golf balls and a crown. At least one recessed portion is defined in the crown and includes a bonding face. The bonding face includes a plurality of regularly arranged holes spaced by a plurality of resilient ribs. The light cover is securely mounted to the recessed portion. The light cover and the holes reduce a weight of the crown of the golf club head and improve a rearward resilient deforming capacity of the striking face. Further, the resilient ribs assure strength of the recessed portion.

17 Claims, 3 Drawing Sheets

GOLF CLUB HEAD WITH IMPROVED STRIKING EFFECT

BACKGROUND OF THE INVENTION

1. Field of the Invention

The present invention relates to a golf club head. In particular, the present invention relates to a golf club head with improved striking effect.

2. Description of Related Art

Japanese Patent Publication No. 2003-111874 discloses a golf club head comprising a body with an opening defined in a crown portion thereof. Two carbon fiber plates are respectively bonded to inner and outer sides of the opening. The carbon fiber plates have a specific gravity of about 1.8 $g/cm^3$ and the body has a specific gravity of about 4.5 $g/cm^3$. By means of using the carbon fiber plates to replace a portion of the crown of the body, the center of gravity of the body is shifted downward and rearward for increasing the inertia moment and for improving the striking effect. Due to provision of the opening in the crown of the body, rearward flexibility (or resilient deforming capacity) of the striking face of the body is improved.

U.S. Pat. No. 6,623,378 discloses a golf club head including an opening in a crown portion of the body, with the opening extending toward a toe and a heel of the body. A carbon fiber plate is mounted to the opening to replace metal material in the crown, toe, and heel of the body. Thus, the center of gravity of the golf club head can be adjusted in a wider range while providing the striking face of the body with a greater rearward flexibility.

Although the resilient deforming capacity of the striking face of each of the above-mentioned golf club heads can be increased, the opening in the crown is without support, resulting in a weak structure in the crown. When the striking face is subjected to a relatively large striking momentum and thus has a relatively large rearward deformation, the carbon fiber plate is compressed and thus breaks. Further, even though the striking face is not subjected to a relatively large striking momentum, repeated deformation of the crown of the body adversely affects the bonding strength and bonding reliability between the opening and the striking plate after a long-term use of the golf club head.

OBJECTS OF THE INVENTION

An object of the present invention is to provide a golf club head with a center of gravity that can be adjusted in a wider range.

Another object of the present invention is to provide a golf club head with improved strength.

A further object of the present invention is to provide a golf club head including a striking face with increased deforming capacity.

Still another object of the present invention is to provide a golf club head with a vibration-absorbing effect.

Yet another object of the present invention is to provide a golf club head with improved gripping comfort.

SUMMARY OF THE INVENTION

In accordance with an aspect of the present invention, a golf club head includes a body and at least one light cover. The body includes a striking face for striking golf balls and a crown. At least one recessed portion is defined in the crown and includes a bonding face. The bonding face includes a plurality of regularly arranged holes spaced by a plurality of resilient ribs.

The light cover is securely mounted to the recessed portion. The light cover and the holes reduce a weight of the crown of the golf club head and improve a rearward resilient deforming capacity of the striking face. Further, the resilient ribs assure strength of the recessed portion.

Each hole of the recessed portion is circular or polygonal such as hexagonal, square, or triangular. Alternatively, each hole of the recessed portion is elongated, conic, or corrugated, with each hole extending from a front side of the body toward a rear side of the body.

The holes of the recessed portion may have different sizes. The recessed portion extends from the crown toward a toe and/or a heel of the body.

The light cover is made of a light material selected from the group comprising carbon fiber, rubber, plastics, magnesium alloy, and aluminum alloy. The light cover is bonded by elastomeric filler to the bonding face of the recessed portion. The elastomeric filler is made of a material selected from the group comprising thermoplastic elastomeric material, rubber, high molecular polymeric material, and polyurethane.

Preferably, the resilient ribs are connected with one another.

Other objects, advantages and novel features of this invention will become more apparent from the following detailed description when taken in conjunction with the accompanying drawings.

Further scope of the applicability of the present invention will became apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
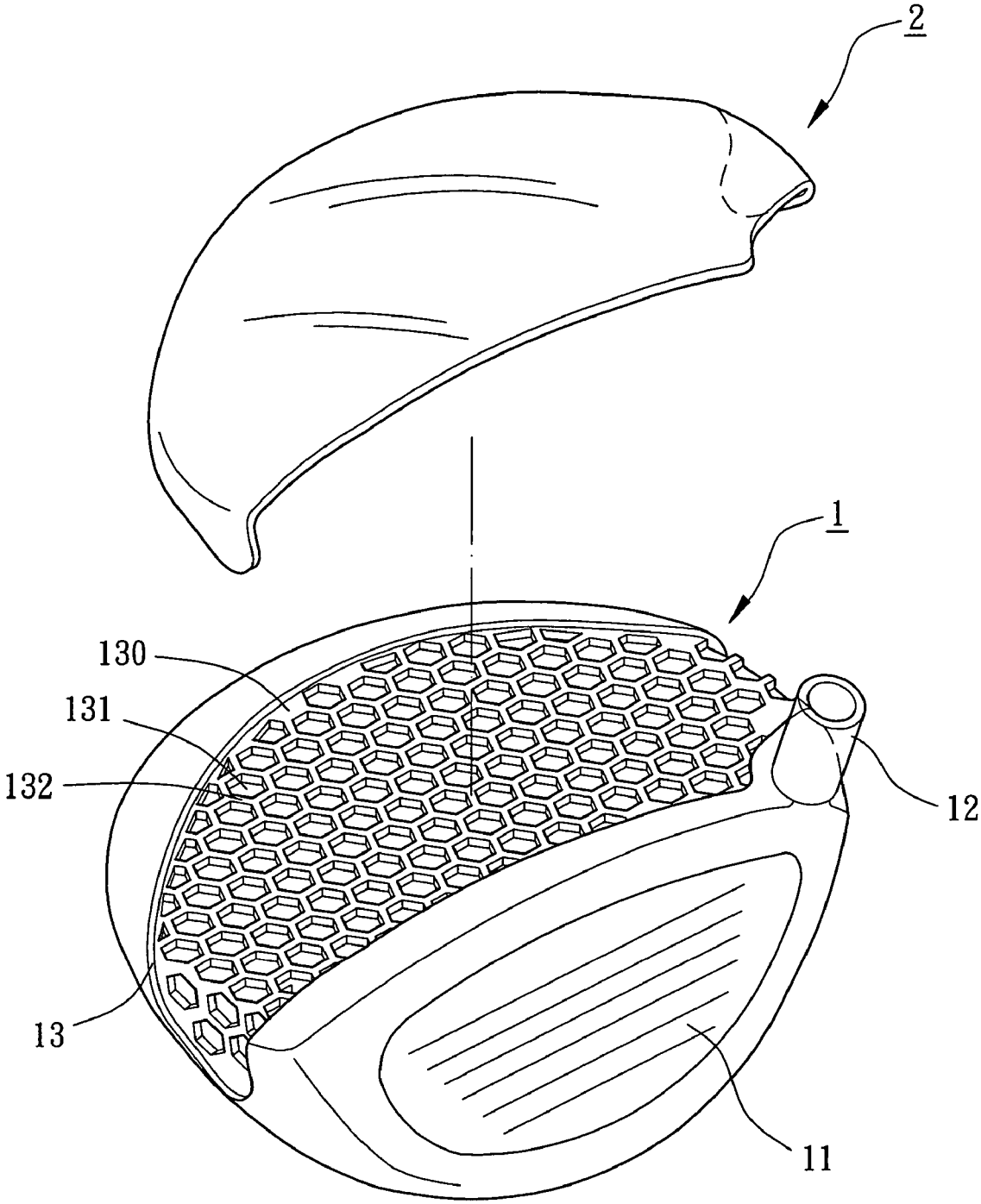
FIG. 1 is an exploded perspective view of a first embodiment of a golf club head in accordance with the present invention.
Figure 2:
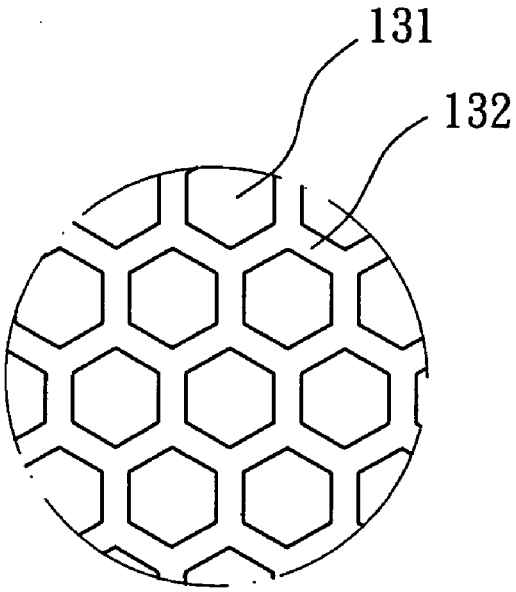
FIG. 2 is an enlarged view of a portion of the golf club head in FIG. 1.

Referring to FIGS. 1 and 2, a first embodiment of a golf club head in accordance with the present invention comprises a body 1 and at least one light cover 2. The body 1 is made of metal or alloy having a relatively large specific gravity greater than 3.5 g/cm$^3$, such as carbon steel, stainless steel, Fe-Mn-Al alloy, titanium alloy, etc. The body 1 can be obtained by bonding several parts. The body 1 includes a striking face 11, a hosel 12, and at least one recessed portion 13. The striking face 11 is located on a front side of the body 1 for striking a golf ball. The hosel 12 is formed on a side of the body 1 for coupling with a shaft (not labeled). The recessed portion 13 is defined in at least a crown of the body 1 and extends toward a toe and a heel of the body 1.

The recessed portion 13 includes a bonding face 130 for bonding with the light cover 2. The bonding face 130 includes a plurality of regularly arranged holes 131 spaced by a plurality of resilient ribs 132. Preferably, each hole 131 is polygonal, such as hexagonal. The resilient ribs 132 are connected with one another and have an appropriate width and thickness to provide a resilient deforming capacity.

The light cover 2 is made of a light material having a specific gravity smaller than 2.7 g/cm$^3$, such as carbon fiber with a specific gravity of 1.8 g/cm$^3$, rubber with a specific gravity of 0.9–1.2 g/cm$^3$, plastics with a specific gravity of 0.9–1.4 g/cm$^3$ (e.g., polyetherimide), magnesium alloy with a specific gravity of 1.74 g/cm$^3$, and aluminum alloy with a specific gravity of 2.7 g/cm$^3$. The light cover 2 has a shape corresponding to that of the recessed portion 13 of the body 1.

Still referring to FIGS. 1 and 2, in assembly, the light cover 2 is bonded by adhesive such as epoxy or elastomeric filler to the bonding face 130 of the recessed portion 13 of the body 1. The elastomeric filling is selected from the group comprising thermoplastic elastomeric material, rubber, and high molecular polymeric material, such as polyurethane elastomeric filler (PU filler).

After assembly, due to significant difference in the specific gravity of the body 1 and the specific gravity of the light cover 2 and due to the holes 131 in the bonding face 130 of the recessed portion 13, the weight of the crown of the body 1 is significantly reduced. Thus, the center of gravity of the golf club head is shifted downward and rearward to a greater extent compared to the conventional design. The inertia moment of the golf club head is increased. Further, since the recessed portion 13 of the body 1 extends from the crown toward the heel and the toe of the body 1, a flexible buffering space is provided between the crown, the heel, and the toe of the body 1, thereby improving the resilient deforming capability of the body 1 and the striking face 11. Further, due to resilient ribs 132 on the bonding face 130 of the recessed portion 13, the structure recessed portion 13 is improved without increasing the weight of the crown and without adversely affecting the resilient deforming capacity of the recessed portion 13.

In a case that the light cover 2 is made from rubber, a vibration-absorbing effect is provided. More specifically, when the striking face 2 is subjected to the striking momentum and thus deforms rearward, the light cover 2 absorbs the residual vibrations not absorbed by the resilient ribs 132 of the recessed portion 130. The gripping comfort is improved and the structural reliability of the resilient ribs 132 is assured. In a case that the elastomeric filler is used to bond the light cover 2 and the bonding face 132 of the recessed portion 130, the vibration-absorbing effect is further improved by the elastomeric filler that also provides a certain vibration-absorbing effect.

Figure 3:
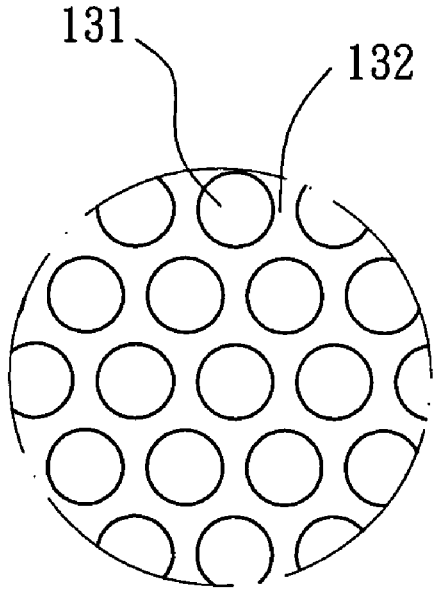
FIG. 3 is a view similar to FIG. 2, illustrating a second embodiment of the golf club head in accordance with the present invention.
Figure 4:
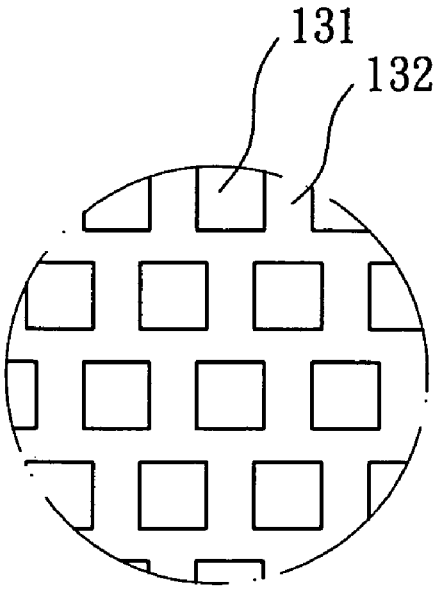
FIG. 4 is a view similar to FIG. 2, illustrating a third embodiment of the golf club head in accordance with the present invention.
Figure 5:
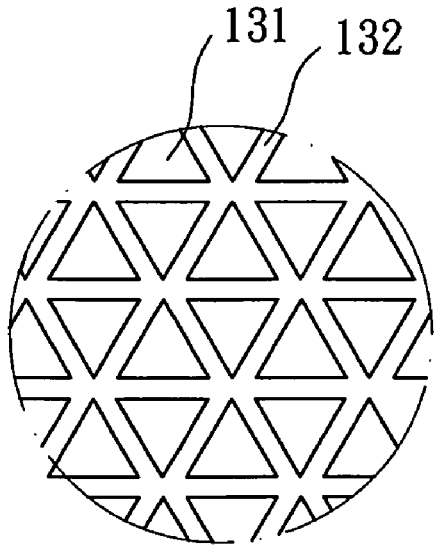
FIG. 5 is a view similar to FIG. 2, illustrating a fourth embodiment of the golf club head in accordance with the present invention.

FIG. 3 illustrates a second embodiment of the invention, wherein each hole 131 is circular. FIG. 4 illustrates a third embodiment of the invention, wherein each hole 131 is square. FIG. 5 illustrates a fourth embodiment of the invention, wherein each hole 131 is triangular. It is noted that each hole 131 may be irregular. Further, the holes 131 may have different sizes.

Figure 6:
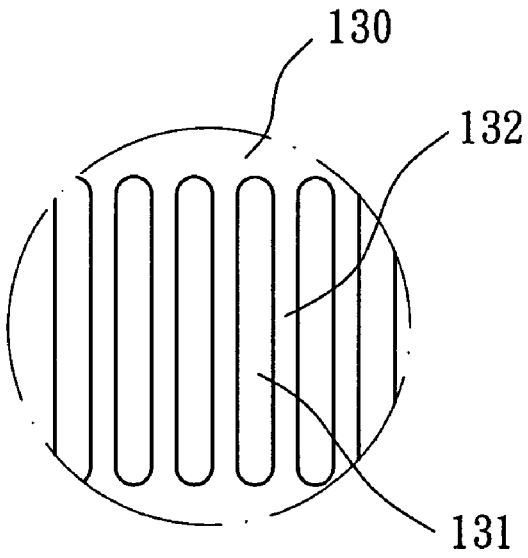
FIG. 6 is a view similar to FIG. 2, illustrating a fifth embodiment of the golf club head in accordance with the present invention.
Figure 7:
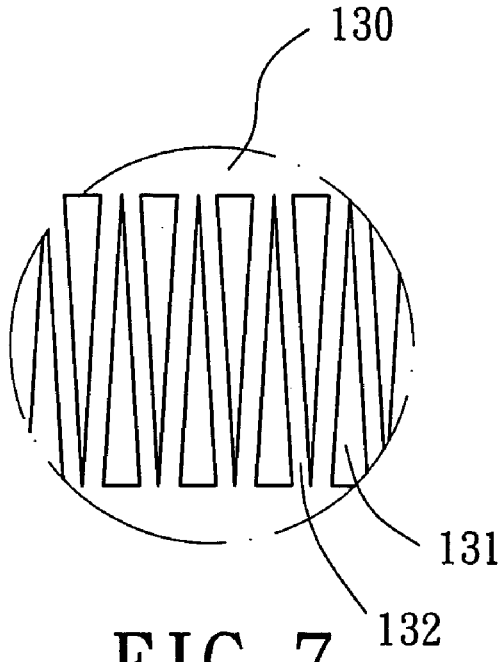
FIG. 7 is a view similar to FIG. 2, illustrating a sixth embodiment of the golf club head in accordance with the present invention.
Figure 8:
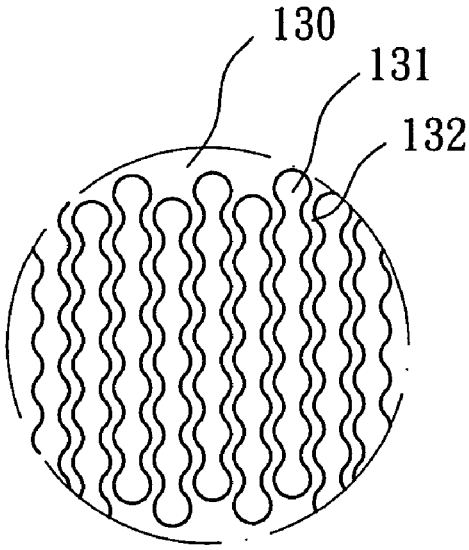
FIG. 8 is a view similar to FIG. 2, illustrating a seventh embodiment of the golf club head in accordance with the present invention.

FIG. 6 illustrates a fifth embodiment of the invention, wherein each hole is elongated and extends from a front side of the body 1 that is adjacent to the striking face 11 toward a rear side of the body 1 that is distal to the striking face 11. FIG. 7 illustrates a sixth embodiment of the invention, wherein each hole 131 is cone-shaped and extends from the front side of the body 1 toward the rear side of the body 1. FIG. 8 illustrates a seventh embodiment of the invention, wherein each hole 131 is corrugated.

The second embodiment through the seventh embodiment provide advantages the same as that of the first embodiment.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A golf club head comprising:

a body including a striking face for striking golf balls, the body including a crown, at least one recessed portion being defined in the crown and including a bonding face integrally formed in the recessed portion of the body, the bonding face including a plurality of regularly arranged holes spaced by a plurality of resilient ribs, said recessed portion running across the crown, said recessed portion further extending from the crown toward at least one of a toe and a heel, and bending to form at least one of a toe-side sidewall portion and a heel-side sidewall portion; and at least one light cover securely mounted to said at least one recessed portion, said light cover extending from a crown portion toward at least one of a toe and a heel, and bending to form at least one of a toe-side sidewall portion or a heel-side sidewall portion, said at least one light cover and said holes reducing a weight of the crown of the golf club head and improving a rearward resilient deforming capacity of the striking face, and the resilient ribs assuring strength of the recessed portion.

2. The golf club head as claimed in claim 1, with each side hole of the recessed portion being one of circular and polygonal.

3. The golf club bead as claimed in claim 2, with each said hole of the recessed portion being one of hexagonal, square, and triangular.

4. The golf club head as claimed in claim 1, with each said hole of the recessed portion being one of elongated, conic, and corrugated.

5. The golf club head as claimed in claim 1, with said holes of the recessed portion having different sizes.

6. The golf club head as claimed in claim 1, with each said hole of the recessed portion extending from a front side of a body toward a rear side of the body.

7. The golf club head as claimed in claim 1, with the light cover being made of a light material selected from the group comprising carbon fiber, rubber, plastics, magnesium alloy, and aluminum alloy.

8. The golf club head as claimed in claim 1, with the light cover being bonded by elastomeric filler to the bonding face of the recessed portion, with the elastomeric filler made of a material selected from the group comprising thermoplastic elastomeric material, rubber, high molecular polymeric material, and polyurethane.

9. The golf club head as claimed in claim 1, with the resilient ribs being connected with one another.

10. The golf club head as claimed in claim 9, with each said hole of the recessed portion being one of circular and polygonal.

11. The golf club head as claimed in claim 10, with each said hole of the recessed portion being one of hexagonal, square, and triangular.

12. The golf club head as claimed in claim 9, with each said hole of the recessed portion being one of elongated, conic, and corrugated.

13. The golf club head as claimed in claim 9, with said holes of the recessed portion having different sizes.

14. The golf club head as claimed in claim 9, with each said hole of the recessed portion extending from a front side of the body toward a rear size of the body.

15. The golf club head as claimed in claim 9, with the light cover being made of a light material selected from the group comprising carbon fiber, rubber, plastics, magnesium alloy, and aluminum alloy.

16. The golf club head as claimed in claim 9, with the light covet being bonded by elastomeric filler to the bonding face of the recessed portion, with the elastomeric filler made of a material selected from the group comprising thermoplastic elastomeric material, rubber, high molecular polymeric material, and polyurethane.

17. The golf club head as claimed in claim 1 with the bonding face extending from the crown toward at least one of a toe and a heel, and bending to form at least one of a toe-side sidewall portion and a heel-side sidewall portion.

* * * * *